US010711223B2

(12) United States Patent
Hahn et al.

(10) Patent No.: US 10,711,223 B2
(45) Date of Patent: Jul. 14, 2020

(54) COMPOSITION COMPRISING POLYALKYLENEIMINES

(71) Applicant: Reckitt Benckiser Finish B.V., Hoofddorp (NL)

(72) Inventors: Karlheinz Ulrich Hahn, Ludwigshafen (DE); Karin Werner, Ludwigshafen (DE)

(73) Assignee: RECKITT BENCKISER FINISH B.V., Hoofddorp (NL)

( * ) Notice: Subject to any disclaimer, the term of this patent is extended or adjusted under 35 U.S.C. 154(b) by 105 days.

(21) Appl. No.: 15/987,187

(22) Filed: May 23, 2018

(65) Prior Publication Data

US 2018/0265809 A1 Sep. 20, 2018

Related U.S. Application Data

(63) Continuation of application No. 13/059,270, filed as application No. PCT/GB2009/002003 on Aug. 14, 2009, now Pat. No. 9,994,796.

(30) Foreign Application Priority Data

Aug. 16, 2008 (GB) ..... 0815022.9

(51) Int. Cl.

| | |
|---|---|
| ***C11D 3/00*** | (2006.01) |
| ***C11D 3/37*** | (2006.01) |
| ***C11D 11/00*** | (2006.01) |

(52) U.S. Cl.

CPC ..... *C11D 3/0073* (2013.01); *C11D 3/3723* (2013.01); *C11D 11/0035* (2013.01)

(58) Field of Classification Search

CPC .. C11D 3/0073; C11D 3/3723; C11D 11/0035

See application file for complete search history.

(56) References Cited

U.S. PATENT DOCUMENTS

| | | | |
|---|---|---|---|
| 5,670,468 | A | 9/1997 | Moens |
| 5,981,456 | A | 11/1999 | Tartakovsky et al. |
| 6,326,343 | B1 | 12/2001 | Ghatlia et al. |
| 6,475,977 | B1 | 11/2002 | Pfeiffer et al. |
| 2003/0171246 | A1 | 9/2003 | Boeckh et al. |
| 2005/0176599 | A1 | 8/2005 | Bergquist et al. |
| 2007/0272277 | A1 | 11/2007 | Jeffreys |
| 2007/0275868 | A1 | 11/2007 | Cooremans et al. |

FOREIGN PATENT DOCUMENTS

| | | | |
|---|---|---|---|
| WO | 9532272 | A1 | 11/1995 |
| WO | 9905248 | A1 | 2/1999 |
| WO | 9907815 | A1 | 2/1999 |
| WO | 0196516 | A1 | 12/2001 |
| WO | 2006108857 | A1 | 10/2006 |

OTHER PUBLICATIONS

Combined Search and Examination Report issued in related European Application No. GB0815022.9 dated Dec. 17, 2008.

*Primary Examiner* — Monique R Peets

(74) *Attorney, Agent, or Firm* — Troutman Sanders LLP; Ryan A. Schneider; Chris N. Davis

(57) ABSTRACT

The present invention provides the use of a composition comprising a polyalkyleneimine and/or salts or derivatives thereof for the prevention of corrosion of non-metallic in organic items during a washing or rinsing process, in particular during an automatic dishwashing process.

20 Claims, No Drawings

COMPOSITION COMPRISING POLYALKYLENEIMINES

CROSS-REFERENCE TO RELATED APPLICATIONS

This application is a continuation application of U.S. patent application Ser. No. 13/059,270, filed 7 Apr. 2011, which is a U.S. National Stage of International Application No. PCT/GB2009/002003, filed 14 Aug. 2009, which claims the benefit of GB 0815022.9, filed 16 Aug. 2008, all of which are herein fully incorporated by reference.

FIELD OF THE INVENTION

The present invention relates to a composition for use in the protection of non-metallic inorganic materials such as glassware in an automatic dishwashing process.

BACKGROUND OF THE INVENTION

The problem of corrosion of non-metallic inorganic items, such as glassware, ceramic and enamel materials, when subjected to automatic dishwashing processes is well recognised in the art. For example, it has been proposed that the problem of glassware corrosion is the result of two separate phenomena. Firstly, it is suggested that the corrosion is due to leakage of minerals from the glass network, accompanied by hydrolysis of the silicate network. Secondly, silicate material is suggested to be released from the glass.

These phenomena can cause damage to glassware after a number of separate wash cycles. The damage may include cloudiness, scratches, streaks and other discoloration/detrimental effects.

Silicate materials have been suggested to be effective in preventing materials from being released by the glass composition. However, the use of silicate compounds can have detrimental side effects, such as the tendency to increase separation of silicate material at the glass surface.

A further solution has been to use zinc, either in metallic form (such as described in U.S. Pat. No. 3,677,820) or in the form of compounds. The use of soluble zinc compounds in the prevention of glassware corrosion in a dishwasher is described in, for example, U.S. Pat. No. 3,255,117.

However, the use of soluble zinc compounds can give rise to detrimental side effects, such as the development of a precipitate of insoluble zinc compounds formed by interaction with other species typically present in the dishwasher wash liquor. This has meant that often insoluble (or rather sparingly soluble) zinc compounds are preferred as the source of zinc in the dishwasher wash liquor. European Patents; EP-A-0 383 480, EP-A-0 383 482 and EP-A-0 387 997) describe the use of water insoluble compounds including zinc silicate, zinc carbonate, basic zinc carbonate ($Zn_2(OH)_2CO_3$), zinc hydroxide, zinc oxalate, zinc monophosphate ($Zn_3(PO_4)_2$) and zinc pyrophosphate ($Zn_2P_2O_7$) for this purpose.

As these zinc compounds have only a low solubility in water it is usual that the compounds are required to have a relatively high surface area, achieved by having a small particle size, in order to attempt to achieve a sufficient concentration in water to obtain the required glass corrosion prevention effect. In this regard EP-A-0 383 480 and EP-A-0 387 997 specify that the zinc compound should have a particle size of lower that 250 □m, whereas EP-A-0 383 482 specifies a particle size of lower than 1.7 mm. However, the use of a small particle size has not been found to overcome the delivery issue and thus, with the use of these insoluble compounds, the problem of glass corrosion effects remains.

The use of glasses and ceramics containing zinc has been found to address the problem of glassware corrosion in a dishwasher. WO-A-01/64823 describes the use of a ceramic composition comprising zinc to protect glassware in an automatic dishwashing process. GB-A-2 372 500 and WO-A-00/39259 describe the use of a soluble glass composition comprising zinc (present in the form of ions) to protect glassware in an automatic dishwashing process. The use of a ceramic/glass zinc containing composition overcomes the problems of poor solubility/precipitation described above whilst offering effective glassware protection.

Bismuth has been used as an additive to aid the prevention of corrosion of glazed glassware corrosion. For example, BE 860180 describes the use of bismuth to avoid damage of decorated, glazed articles.

However, the value of bismuth in this purpose has been diminished by the detrimental effects that the use of bismuth compound has on other components of the washing process or detergent composition. In soluble bismuth compounds can cause the formation of stains on kitchenware items e.g. glassware and cutlery which come into contact with these compounds. For these reasons the use of bismuth alone as a glaze protector has been avoided, although a combination of zinc and bismuth has been found to address this issue (see WO-A-04/106476).

It has also been found that the use of heavy metal compounds in some circumstances reduce the bleaching performance of a dishwashing composition on bleachable stains such as tea stains.

Furthermore, for environmental reasons, it is becoming increasingly desirable to limit (and especially to avoid) the use of heavy metals in detergent formulations.

Moreover, when insoluble materials are incorporated into compositions it is generally necessary to use them in their solid form. As suggested above, this can require careful control of the particle size of the material and can also make them awkward to use in a factory environment as problems such as release of a dust containing the material may occur. It is therefore frequently desirable to use raw materials which are soluble/in liquid form.

A further problem is that the known corrosion prevention agents for non-metallic surfaces, such as glassware corrosion agents, are only effective in the dishwashing cycle in which they are used. Thus, if the consumer does not ensure that a composition comprising these agents is used in each cycle then protection against corrosion of non-metallic items is not obtained in each cycle.

Yet another problem some known types of corrosion prevention agents, e.g. zinc containing agent, is they suffer from reduced efficacy in detergent formulations which comprise builders with a strong complexing action such as phosphates and aminocarboxylates.

Still a further problem is that some of the known corrosion prevention agents, such as bismuth containing agents, are in relatively short supply. Accordingly, there is always a need to find alternative materials which are more readily available and/or less expensive.

It is an object of the present invention to address one or more of the above problems.

In particular, it is an object of the present invention to provide a corrosion prevention agent/composition which reduces, or avoids, detrimental effects on items treated therewith, e.g., which does not stain such items.

It is a further object of the present invention to provide a corrosion prevention agent/composition which reduces, or avoids, detrimental effects on either i) the other ingredients in the composition into which it is incorporated or ii) which is compatible with strongly complexing builders such as phosphates and aminocarboxylates.

It is still a further object, for environmental reasons, to provide a corrosion prevention agent/composition which does not contain heavy metals, which agent is to be used on non-metallic inorganic items.

Another object is to provide a corrosion prevention agent/composition for non-metallic inorganic items which is readily soluble in water and/or can be provided in liquid or gel form.

Still a further object of the present invention is to provide a corrosion prevention agent/composition for non-metallic inorganic items which agent provides the prevention effect even if it is not used in each cycle of the dishwasher or every time the dishwasher is operated.

Another object of the present invention is to provide a corrosion prevention/composition agent for non-metallic non-inorganic items which is readily available and/or relatively inexpensive compared to such currently available corrosion protection agents.

It has now been found that by the use of certain polymeric materials which do not contain heavy metals that one or more of the above problems is/are addressed.

Thus, according to the present invention there is provided the use of a composition comprising a polyalkyleneimine and/or a salt or derivative thereof for the prevention of corrosion of non-metallic inorganic items during a washing or rinsing process.

Compositions, such as detergent compositions, comprising polyalkyleneimines such as polyethyleneimines are known.

Detergent compositions comprising up to 5% wt of polyethyleneimine (PEI), are disclosed in WO99/07815. In the detergent compositions disclosed therein, the PEI is used as a replacement for phosphonate chelants and are said to provide fabric stain removal properties in the absence of bleaching compounds.

WO99/32272 discloses automatic dishwashing compositions comprising ethoxylated poly(ethyleneimine) as a soil dispersing agent to improve whitening/cleaning benefits.

WO2006/108857 discloses PEI compounds as an additive to laundry detergents and cleaning compositions for removing greasy soil from textiles and hard surfaces.

US2003/0171246 discloses compositions comprising polymer dispersions and a polyethyleneimine to prepare compositions with soil release action which can be used, for example, in the rinse cycle of a domestic washing machine.

WO01/96516 discloses a poly(ethyleneimine) ethoxylate in detergent compositions to be used for cleaning surfaces such as the exterior surface of a vehicle without the subsequent appearance of water-marks thereon. The poly(ethyleneimine) ethoxylate is included in the detergent compositions as soil-suspending polymer.

US2005/0176599 discloses the use of polyalkyleneimines as a cationic charge booster to be used as part of a fragrance carrier system in fabric care products to improve fragrance deposition onto the laundered fabric.

However, none of the aforementioned prior art discloses the use of polyalkyleneimines and/or a salt or derivative thereof for the prevention of corrosion of non-metallic in organic items during a washing or rinsing process.

BRIEF SUMMARY OF THE INVENTION

In one aspect, the disclosure provides a composition comprising a polyalkyleneimine, a salt of a polyalkyleneimine, and/or a derivative of a polyalkyleneimine in an amount of 0.01 mg to 10 mg per wash and/or rinse cycle of an automatic dishwashing machine.

In some embodiments, the number average molecular weight of the polyalkyleneimine, the salt of the polyalkyleneimine, and/or the derivative of the polyalkyleneimine is in the range of from 100 to 5,000,000.

In some embodiments, the polyalkyleneimine, the salt of the polyalkyleneimine, and/or the derivative of the polyalkyleneimine comprises a polyethyleneimine, a salt of a polyethyleneimine, and a derivative of a polyethyleneimine. In some embodiments, the composition comprises a polyethyleneimine.

In some embodiments, the composition is an automatic dishwashing composition comprising the polyalkyleneimine, the salt of the polyalkyleneimine, and/or the derivative of the polyalkyleneimine in an amount of from 0.0001 wt % to 50 wt % of the composition.

In some embodiments, the composition is an automatic dishwashing rinse aid comprising the polyalkyleneimine, the salt of the polyalkyleneimine, and/or the derivative of the polyalkyleneimine in an amount of from 0.0005 wt % to 70 wt % of the composition.

In some embodiments, the composition is a water softening salt composition comprising the polyalkyleneimine, the salt of the polyalkyleneimine, and/or the derivative of the polyalkyleneimine in an amount of from 0.0001 wt % to 90 wt % of the composition.

In some embodiments, the composition is a machine cleaner or machine additive composition comprising the polyalkyleneimine, the salt of the polyalkyleneimine, and/or the derivative of the polyalkyleneimine in an amount of from 0.0001% wt-90% wt of the composition.

In any of the foregoing embodiments, the composition is in a form selected from the group consisting of a liquid, a gel, a powder, and a tablet. In some embodiments, the composition is at least partially present in a water-soluble pouch. In other embodiments, the composition is at least partially coated with a water-soluble coating.

In some embodiments, when the composition is in the form of a liquid or a gel, the polyalkyleneimine, the salt of the polyalkyleneimine, and/or the derivative of the polyalkyleneimine is soluble in the liquid or gel.

In some embodiments, when the composition is in the form of a liquid or a gel, the polyalkyleneimine, the salt of the polyalkyleneimine, and/or the derivative of the polyalkyleneimine is insoluble in the liquid or gel.

In some embodiments, the water-soluble pouch comprises the polyalkyleneimine, the salt of the polyalkyleneimine, and/or the derivative of the polyalkyleneimine.

In some embodiments, the water-soluble coating comprises the polyalkyleneimine, the salt of the polyalkyleneimine, and/or the derivative of the polyalkyleneimine.

In a related aspect, the disclosure provides an automatic dishwashing detergent composition comprising a polyalkyleneimine, a salt of a polyalkyleneimine, and/or a derivative of a polyalkyleneimine in an amount of 0.01 mg to 10 mg per wash and/or rinse cycle of an automatic dishwashing machine.

In some embodiments, the polyalkyleneimine, the salt of the polyalkyleneimine, and/or the derivative of the polyalkyleneimine is present in an amount of from 0.0001% wt-50% wt of the automatic dishwashing detergent composition.

In some embodiments, the automatic dishwashing detergent is in the form of a tablet.

In some embodiments, the automatic dishwashing detergent is at least partially present in a water-soluble pouch.

In some embodiments, the polyalkyleneimine, the salt of the polyalkyleneimine, and/or the derivative of the polyalkyleneimine has a number average molecular weight in the range of from 100 to 5,000,000.

It is preferred that the cleaning and/or rinsing process of the present invention are carried out on non-metallic inorganic items are glassware such as glass, ceramic, glass ceramic and enamel items to prevent corrosion thereof.

It is especially preferred that the use according to the present invention occurs in an automatic dishwashing process.

The polyalkyleneimine preferably comprises a polyethyleneimine and most preferably it is a polyethyleneimine.

It is especially preferred that the number average molecular weight of the polyalkyleneimine and/or salt or derivative thereof is in the range of from 100 to 5,000,000.

According to one embodiment of the present invention, the composition used is an automatic dishwashing composition comprising the polyalkyleneimine and/or salt or derivative thereof in an amount of from 0.0001 wt % to 50 wt % of the composition.

According to another embodiment, the composition used is an automatic dishwashing rinse aid comprising the polyalkyleneimine and/or salt or derivative thereof in an amount of from 0.0005 wt % to 70 wt % of the composition.

According to yet another embodiment, the composition used is a water softening salt composition comprising the polyalkyleneimine and/or salt or derivative thereof in an amount of from 0.0001 wt % to 90 wt % of the composition.

DETAILED DESCRIPTION OF THE INVENTION

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named. In other words, the terms "a," "an," and "the" do not denote a limitation of quantity, but rather denote the presence of "at least one" of the referenced item.

As used herein, the term "and/or" may mean "and," it may mean "or," it may mean "exclusive-or," it may mean "one," it may mean "some, but not all," it may mean "neither," and/or it may mean "both." The term "or" is intended to mean an inclusive or.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose. It is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value. Further, the term "about" means within an acceptable error range for the particular value as determined by one of ordinary skill in the art, which will depend in part on how the value is measured or determined, i.e., the limitations of the measurement system. For example, "about" can mean within an acceptable standard deviation, per the practice in the art. Alternatively, "about" can mean a range of up to ±20%, preferably up to ±10%, more preferably up to ±5%, and more preferably still up to ±1% of a given value. Alternatively, particularly with respect to biological systems or processes, the term can mean within an order of magnitude, preferably within 2-fold, of a value. Where particular values are described in the application and claims, unless otherwise stated, the term "about" is implicit and in this context means within an acceptable error range for the particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

Throughout this description, various components may be identified having specific values or parameters, however, these items are provided as exemplary embodiments. Indeed, the exemplary embodiments do not limit the various aspects and concepts of the present invention as many comparable parameters, sizes, ranges, and/or values may be implemented. The terms "first," "second," and the like, "primary," "secondary," and the like, do not denote any order, quantity, or importance, but rather are used to distinguish one element from another.

It is noted that terms like "specifically," "preferably," "typically," "generally," and "often" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. It is also noted that terms like "substantially" and "about" are utilized herein to represent the inherent degree of uncertainty that may be attributed to any quantitative comparison, value, measurement, or other representation.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "50 mm" is intended to mean "about 50 mm."

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described hereinafter as making up the various elements of the present invention are intended to be illustrative and not restrictive. Many suitable materials that would perform the same or a similar function as the materials described herein are intended to be embraced within the scope of the invention. Such other materials not described herein can include, but are not limited to, materials that are developed after the time of the development of the invention, for example. Any dimensions listed in the various drawings are for illustrative purposes only and are not intended to be limiting. Other dimensions and proportions are contemplated and intended to be included within the scope of the invention.

In the present invention it is understood that the term non-metallic inorganic item includes items made of glass (such as drinking glasses and plates) which may be decorated (such as with a glaze and or with etching/glass addition). The term non-metallic inorganic item is also understood to include other items of dishware, which may comprise a material other than glass (such as a ceramic). A group of materials called glass ceramics (which have a state intermediate between glass and ceramic) are also encompassed by the term "non-metallic inorganic items. Moreover, items which can have a glass/glaze coating and/or decoration (such as a glazed ceramic plate or which have an enamelled layer e.g., an enamelled aluminium pan) are also included in the term non-metallic inorganic item.

The term polyalkyleneimine as used herein encompasses any alkyleneimine comprising 2 or more alkyleneimine repeating units, and thus alkyleneimine oligomers, such as ethyleneimine oligomers are included within the term. Typically, the polyalkyleneimine will comprise from 2 to 50,000 alkyleneimine repeating units, preferably 10 to 25,000, such as 50 to 10,0000.

Unless otherwise stated or required by the context, all percentages herein are given as weight percentages based on the total weight of the composition. Reference herein to "polyalkyleneimine(s)" includes reference to the salts and/or derivatives thereof.

It has been found that polyalkyleneimines and/or salts or derivatives thereof have especially beneficial properties in the prevention of corrosion of non-metallic inorganic items such as glassware, glass ceramics, ceramics and enamels. This has been found particularly in automatic dishwashing processes. Indeed, not only is the composition highly effective at protecting normal glassware but also the composition has been found to be highly effective in protecting glazed glassware/crockery. Thus, a single compound may now be used to provide corrosion protection for both decorated glassware/crockery and non-decorated glassware especially in a automatic dishwasher.

Additionally, the protection effects on non-metallic inorganic items have been found to be substantive. Namely the beneficial effects, e.g., of glass protection and glaze protection have been found to be achieved in subsequent cleaning and/or rinsing cycles (even in the absence of the composition of the present invention in these subsequent cleaning and/or rinsing cycles).

The polyalkyleneimine and/or salts or derivatives thereof is used in an effective amount to provide the aforementioned corrosion protection effects during a washing or rinsing cycle. The polyalkyleneimine is preferably used in a washing or rinsing cycle in an automatic dishwasher in an amount of from 0.01 mg up to 10 g more, preferably from 0.05 mg up to 5 g, more preferably from 0.1 mg up to 1 g and most preferably from 0.5 mg up to 100 mg per wash or rinse cycle. It is also possible to use the polyalkyleneimine in both the wash and the rinse cycles of an automatic dishwashing machine.

Most preferably, the polyalkyleneimine is part of a detergent or rinse formulation. The detergent formulation may be any common detergent formulation of the type usually employed with automatic dishwashers. The formulation may comprise a liquid, gel, powder or tablet formulation which can be at least partially packed or filled into a water soluble pouch. Similarly, a coating may be used to coat at least a portion of the formulation.

Where the formulation is a liquid/gel, generally the polyalkyleneimine is present in solution within the liquid/gel. However, it is also contemplated to have the polyalkyleneimine present in the liquid/gel in the form of an insoluble solid salt/compound so that the polyalkyleneimine may comprise a suspended particle (e.g., such as a "speckle" typically found in these formulations). For compositions having a water soluble coating or pouch it is contemplated to have the polyalkyleneimine as part of the coating/pouch composition.

The detergent formulation normally comprises other components which are typically found in dishwasher detergent formulations. In this regard the detergent formulation typically comprises one or more components selected from the group comprising surfactants (non-ionic, anionic, cationic and zwitterionic), builders, enzymes, foam suppressants, bleaches, bleach activators, thickeners, perfumes, dyes, corrosion inhibitors.

When the polyalkyleneimine is present in an automatic dishwasher detergent composition, the polyalkyleneimine preferably comprises from 0.0001% wt-50% wt of the detergent composition, more preferably from 0.0005% wt-5% wt and most preferably 0.001% wt-1% wt of the dishwasher detergent composition (e.g., 10 mg for a 20 g tablet).

The polyalkyleneimine may be also be included in a rinse aid composition. In this case the rinse aid composition preferably comprises from 0.0005% wt-70% wt of the polyalkyleneimine, more preferably from 0.001% wt-50% wt and most preferably 0.005% wt-25% wt, such as from 0.01% wt-5% wt of the rinse aid composition.

The polyalkyleneimine may be also be included in a water softening salt composition. These are commonly used for the regeneration of the ion exchanger present in an automatic dishwasher. In this case the water softening salt composition preferably comprises from 0.0001% wt-90% wt of the water softening salt composition, more preferably 0.001% wt-50% wt and most preferably 0.005% wt-25% wt such as 0.01 to 10% wt of the water softening salt composition.

The polyalkyleneimine may be included in a machine cleaner/machine additive composition. In either of these cases the composition comprises from 0.0001% wt-90% wt of the composition, more preferably from 0.0005% wt-50% wt and most preferably 0.001% wt-10% wt of the composition.

Polyalkyleneimines are commercially available from different suppliers under various trade names e.g., Lugalvan™ P (ex BASF). Polyalkyleneimines are known to have a very widespread range of average molecular weights, from around 100 up to several million, preferably in the range of from about 100 to about 5,000,000, most preferably of from about 250 to 1,000,000, such as from about 400 to about 100,000. The alkylene group, which is preferably a linear or branched chain, may also for example be cyclic. The alkylene group preferably has from 1 to 50 C atoms, more preferably from 2 to 20, such as from 2 to 5, such as ethylene. These polymers can be linear, branched or end capped. Suitable end-caps include alkylenediamines such as C2-C5 alkylenediamines e.g., ethylenediamines. The polymers may be derivatized e.g. by alkoxylation, ethoxylation, propoxylation protonated, and be provided with or without a counterion. If a counter ion is present any suitable counterion may be used. If a counterion is used which is known to have negative effects in the dishwashing process. e.g., chloride, the chloride counterion is preferably present in the dishwashing process at a concentration of less than 200 mg/litre of dishwashing liquor, more preferably at less than 100 mg/litre, most preferably less than 50 mg/litre in order to avoid rusting, pitting or other types of corrosion on stainless steel e.g., cutlery. Common commercially available polyalkyleneimines are usually available as an admixture mixture of one or more of the above species. A solvent such as water may be present. Any one of these species would be suitable for use in the present invention.

The polyalkyleneimines can be incorporated into the compositions in which they are to be included in any suitable manner.

EXAMPLES

The invention is now further described with reference to the following nonlimiting Examples. Further examples will be apparent to the person skilled in the art.

The present invention is also described and demonstrated by way of the following examples. However, the use of these and other examples anywhere in the specification is illustrative only and in no way limits the scope and meaning of the invention or of any exemplified term. Likewise, the invention is not limited to any particular preferred embodiments described here. Indeed, many modifications and variations of the invention may be apparent to those skilled in the art upon reading this specification, and such variations can be made without departing from the invention in spirit or in scope. The invention is therefore to be limited only by the terms of the appended claims along with the full scope of equivalents to which those claims are entitled.

In these Examples, the detergent composition in Table 1 was used as a detergent formulation base. All percentages are by weight based on the total weight of the composition.

TABLE 1

| Component | % wt |
|---|---|
| Sodium Tripolyphosphate | 45.0 |
| Sodium Carbonate | 24.0 |
| Sodium Bicarbonate | 3.0 |
| Citric acid | 1.0 |
| Cellulose | 1.0 |
| Lactose | 1.0 |
| Sodium disilicate | 3.0 |
| Polyethyleneglycol (PEG) | 7.0 |
| Sodium Percarbonate | 10.0 |
| TAED | 2.0 |
| Protease | 0.9 |
| Amylase | 0.4 |
| Non-ionic Surfactant*[1] | 1.0 |
| Benzotriazole | 0.2 |
| Perfume + Dye | 0.5 |

*[1]Plurafac[RTM] LF500 (ex BASF, Germany)

Test Method

In the examples, test glasses were washed 50 times in a special endurance test dishwasher (Bosch® SGS3322).

Cleaning Dosage: 20 g of the base detergent described above in Table 1, optionally further including polyalkyleneimine (with the amount specified in the Examples), with automatic dosing at the beginning of the cleaning cycle.

Water Hardness in the machine: <1 dGH, central softening through ion exchangers, internal ion exchangers not in operation.

Cleaning program 65° C. (both the cleaning and the rinse cycle were operated at 65° C.).

Water consumption per cycle: 20 litres.

There was no soiling on the glassware tested, i.e., they were new, unsoiled, glasses.

The test report comprised the following types of glass, for each glass pattern 2 samples were examined:

Clear Glasses

Arc-International (France): "Longchamp", No. 3 17 cl Stemglass, lead crystal glass; "Arcoroc® Elegance", Wineglass, 14.5 cl.

Nachtmann Bleikristallwerke (Germany): "Julia Paola", Weißweinkelch No. 2; Royal Leerdam (Netherlands); "Fiori", 14 cl.

Stölze Lausitz GmbH) (Germany): "Wasserkelch Professional 205 00 11", 450 ml.

Decorated Glassware

Ritzenhoff & Breker, (Germany): "Kinderbecher Flirt", Leonardo (Germany) "Latte Macchiato".

Konitz Porzellan GmbH (Germany): "Longdrink—Saft Escapada Streifen".

The weight loss was determined gravimetrically after 25 to 50 test washes. Visible changes to the glass surface were evaluated in natural light (iridescence, line corrosion and decoration damage) and/or in a special light box (glass clouding, line corrosion and decoration damage). The dimensions of the light box were 70 cm×40 cm×65 cm (l×b×h) and the inside of the box was painted matt black. The box was lit from above with an L 20 w/25 S (60 cm long) Osram lamp, which was covered in front with a screen. Shelves were disposed in the box on which the glasses were placed for evaluation. The box was open at the front.

The glass corrosion was evaluated using the following criteria; glass clouding (GC), line corrosion (LC), decoration damage (DD) and iridescence (IR). For each parameter a score was given in accordance with the Table below.

| Evaluation | Damage Impact |
|---|---|
| 0 | No damage |
| 1 | First minor damage/hardly visible |
| 2 | Slight damage, visible to expert or in the light box |
| 3 | Visible damage |
| 4 | Strong damage, clearly visible |

Comparative Example 1

The detergent composition of Table 1 was used as a detergent formulation base. The formulation was used in tablet form. The results of the tests are shown in Table 2a (Glass Corrosion) and Table 2b (Mass Loss).

TABLE 2a

| Glass Corrosion | | | | | | |
|---|---|---|---|---|---|---|
| | 25 cycles | | | 50 Cycles | | |
| Glasses | GC | LC | IR | GC | LC | IR |
| Longchamp | 2.0 | 2.0 | 1.0 | 3.0 | 3.0 | 1.0 |
| Julia Paola | 2.5 | 0.5 | 0.5 | 3.0 | 0.5 | 0.5 |
| Stoelzle 205 00 11 | 2.0 | 1.0 | 2.0 | 3.0 | 2.5 | 2.0 |
| Arcoroc $^{RTM}$ Elegance | 3.0 | 2.0 | 1.0 | 3.5 | 3.5 | 1.5 |
| Fiori | 2.5 | 2.5 | 1.0 | 3.0 | 3.5 | 1.0 |
| Average | 2.4 | 1.6 | 1.1 | 3.1 | 2.6 | 1.2 |
| Decorated Glassware | DD | | | DD | | |
| Sweet Animals | 2.5 | | | 3.0 | | |
| Latte Macchiato | 3.0 | | | 3.5 | | |
| Escapada | 3.0 | | | 3.5 | | |
| Average | 2.8 | | | 3.3 | | |

TABLE 2b

| Mass Loss | | |
|---|---|---|
| | 25 cycles Mass Loss (mg) | 50 cycles Mass Loss (mg) |
| Glasses | | |
| Longchamp | 34 | 59 |
| Julia Paola | 26 | 56 |
| Stoelzle 205 00 11 | 10 | 34 |
| Arcoroc $^{RTM}$ Elegance | 11 | 14 |
| Fiori | 3 | 13 |
| Sum | 84 | 177 |
| Decorated Glassware | | |
| Sweet Animals | 138 | 289 |
| Latte Macchiato | 27 | 53 |
| Escapada | 235 | 468 |
| Sum | 400 | 810 |

Example 1

In this example, 100 mg of polyethyleneimine, ethylenediamine end-capped (average Mw~800 by LS, average Mn~600 by GPC, ex Sigma Aldrich Co) was added in addition to the detergent composition of Table 1. The results of the tests are shown in Table 3a (Glass Corrosion) and Table 3b (Mass Loss).

TABLE 3a

| Glass Corrosion | | | | | | |
|---|---|---|---|---|---|---|
| | 25 cycles | | | 50 Cycles | | |
| Glasses | GC | LC | IR | GC | LC | IR |
| Longchamp | 1.5 | 1.0 | 1.5 | 2.0 | 1.0 | 1.0 |
| Julia Paola | 0.5 | 0.5 | 0.5 | 1.0 | 0.5 | 0.5 |
| Stoelzle 205 00 11 | 2.0 | 1.5 | 1.5 | 2.0 | 1.5 | 1.5 |
| Arcoroc $^{RTM}$ Elegance | 2.0 | 1.5 | 1.5 | 2.5 | 2.0 | 1.0 |
| Fiori | 0.5 | 1.0 | 1.0 | 1.0 | 1.5 | 1.0 |
| Average | 0.3 | 1.1 | 1.2 | 1.7 | 1.3 | 1.0 |
| Decorated Glassware | DD | | | DD | | |
| Sweet Animals | 2.5 | | | 3.0 | | |
| Latte Macchiato | 2.0 | | | 2.0 | | |
| Escapada | 2.0 | | | 2.5 | | |
| Average | 2.2 | | | 2.5 | | |

TABLE 3b

| Mass Loss | | |
|---|---|---|
| | 25 cycles Mass Loss (mg) | 50 cycles Mass Loss (mg) |
| Glasses | | |
| Longchamp | 8 | 14 |
| Julia Paola | 6 | 14 |
| Stoelzle 205 00 11 | 5 | 10 |
| Arcoroc $^{RTM}$ Elegance | 1 | 3 |
| Fiori | 4 | 5 |
| Sum | 24 | 47 |
| Decorated Glassware | | |
| Sweet Animals | 56 | 111 |
| Latte Macchiato | 12 | 28 |
| Escapada | 88 | 184 |
| Sum | 156 | 323 |

In contrast to Comparative Example 1, the addition of 100 mg (0.5 wt %) polyethyleneimine, ethylenediamine end capped provides both non-decorated glassware corrosion protection and decorated glassware protection. The visual surface damage and the mass loss on the test glasses were reduced with the composition of Example 1 compared to washing with the comparative detergent composition of Table 1.

Additionally, a long-term corrosion protection benefit was observed with Example 1. Following the test with the polyethyleneimine, ethylenediamine end capped the test of the Comparative Example 1 (using the detergent of Table 1 and a new set of dishware) was repeated in the automatic dishwasher used for the test of Example 1. Surprisingly, even though no polyalkyleneimine had been added to the formulation of Comparative Example 1 less damage occurred to clear and decorated glassware than would have been expected from the results shown above obtained for Comparative Example 1.

Without intending to be bound by any theory, it is postulated that the polyalkyleneimine may be absorbed/adsorbed onto parts of the dishwasher (e.g. tubes, spray-arms, racks, sieves) and is released over a number of cycles thereafter thus providing a corrosion protection benefit in subsequent cycles.

Accordingly, for any new test the dishwasher had to be "cleaned" for 50 cycles with the detergent of Table 1 without adding any polyalkyleneimine, otherwise the polyalkyleneimine "residues" inside the dishwasher could have influenced the results of any subsequent test.

Example 2

In this example, 100 mg of ethyleneimine, oligomer mixture; a mixture of linear and branched chains and with 5-25% wt tetraethylenepentamine (average Mn~423, ex Sigma Aldrich Co) was added in addition to the detergent composition of Table 1. The results of the tests are shown in Table 4a (Glass Corrosion) and Table 4b (Mass Loss).

TABLE 4a

| Glass Corrosion | | | | | | |
|---|---|---|---|---|---|---|
| | 25 cycles | | | 50 Cycles | | |
| Glasses | GC | LC | IR | GC | LC | IR |
| Longchamp | 0.5 | 0.5 | 1.0 | 1.5 | 0.5 | 1.0 |
| Julia Paola | 0.0 | 0.0 | 0.5 | 1.0 | 0.5 | 0.5 |
| Stoelzle 205 00 11 | 1.0 | 0.5 | 1.0 | 1.0 | 1.0 | 1.0 |
| Arcoroc $^{RTM}$ Elegance | 2.0 | 1.5 | 1.0 | 2.5 | 2.0 | 1.0 |
| Fiori | 0.0 | 0.5 | 0.5 | 0.5 | 1.0 | 1.0 |
| Average | 0.7 | 0.6 | 0.8 | 1.3 | 1.0 | 0.9 |
| Decorated Glassware | DD | | | DD | | |
| Sweet Animals | 3.0 | | | 3.5 | | |
| Latte Macchiato | 3.0 | | | 3.5 | | |
| Escapada | 2.5 | | | 3.5 | | |
| Average | 2.8 | | | 3.5 | | |

TABLE 4b

| Mass Loss | | |
|---|---|---|
| | 25 cycles Mass Loss (mg) | 50 cycles Mass Loss (mg) |
| Glasses | | |
| Longchamp | 9 | 13 |
| Julia Paola | 3 | 12 |
| Stoelzle 205 00 11 | 1 | 10 |
| Arcoroc $^{RTM}$ elegance | 5 | 11 |
| Fiori | 6 | 9 |
| Sum | 23 | 53 |
| Decorated Glassware | | |
| Sweet Animals | 102 | 213 |
| Latte Macchiato | 7 | 26 |
| Escapada | 160 | 300 |
| Sum | 269 | 539 |

In contrast to Comparative Example 1, the addition of 100 mg (0.5 wt %) of the ethyleneimine, oligomer mixture above provides non-decorated glassware corrosion protection. The visual surface modifications and the mass loss on the test glasses were reduced compared to Comparative Example 1.

For decorated glassware the addition of the ethyleneimine, oligomer mixture above reduced the mass loss of these decorated glassware.

Example 3

In this example 1 mg (0.005 wt %) of branched polyethyleneimine (average Mw~25,000 by LS, average Mn~10,000 by GPC, ex Sigma Aldrich Co) was added to the detergent composition of Table 1. The results of the tests are shown in Table 5a (Glass Corrosion) and Table 5b (Mass Loss).

TABLE 5a

| Glass Corrosion | | | | | | |
|---|---|---|---|---|---|---|
| | 25 cycles | | | 50 Cycles | | |
| Glasses | GC | LC | IR | GC | LC | IR |
| Longchamp | 1.5 | 1.5 | 1.0 | 2.5 | 1.5 | 1.0 |
| Julia Paola | 1.0 | 0.5 | 1.5 | 1.5 | 0.5 | 1.5 |
| Stoelzle 205 00 11 | 2.0 | 1.0 | 2.0 | 2.5 | 1.5 | 1.5 |
| Arcoroc $^{RTM}$ Elegance | 2.5 | 2.0 | 1.5 | 2.5 | 2.0 | 1.5 |
| Fiori | 1.5 | 1.5 | 1.0 | 2.0 | 1.5 | 1.0 |
| Average | 1.7 | 1.3 | 1.4 | 2.2 | 1.4 | 1.3 |
| Decorated Glassware | DD | | | DD | | |
| Sweet Animals | 2.5 | | | 3.0 | | |
| Latte Macchiato | 2.5 | | | 3.0 | | |
| Escapada | 2.0 | | | 2.5 | | |
| Average | 2.3 | | | 2.8 | | |

TABLE 5b

| Mass Loss | | |
|---|---|---|
| | 25 cycles Mass Loss (mg) | 50 cycles Mass Loss (mg) |
| Glasses | | |
| Longchamp | 11 | 15 |
| Julia Paola | 10 | 19 |
| Stoelzle 205 00 11 | 8 | 19 |
| Arcoroc $^{RTM}$ elegance | 5 | 9 |
| Fiori | 2 | 5 |
| Sum | 38 | 67 |
| Decorated Glassware | | |
| Sweet Animals | 88 | 192 |
| Latte Macchiato | 22 | 28 |
| Escapada | 132 | 299 |
| Sum | 242 | 518 |

The addition of only 1 mg (0.005 wt %) of branched polyethylenimine, provides non-decorated glassware corrosion protection and decorated glassware protection. Glass clouding, line corrosion, décor damage and mass loss are all reduced.

Example 4

In this example a bleach and phosphorus-free detergent composition base as shown in Table 6 was used as a base formulation. The formulation was used in tablet form (having a mass of 20 g) with 1 tablet per wash being dispensed at the beginning of the main wash.

The protection performance on glasses and decoration with 100 mg of Lugalvan P™ (ex BASF, Germany) used in addition to the tablet is shown in Table 7a (Glass Corrosion) and Table 7b (Mass Loss).

TABLE 6

| Component | % |
|---|---|
| Methylglycine Diacetate (MGDA) | 62.0 |
| Sodium Carbonate | 9.0 |

TABLE 6-continued

| Component | % |
|---|---|
| Surfactants*2 | 6.0 |
| Acrylic/sulphonic copolymer*3 | 5.0 |
| Polyacrylic acid*4 | 5.0 |
| PVP-Copolymer*5 | 2.0 |
| Sodium Disilicate | 3.0 |
| Polyethylenglycol (PEG) | 5.0 |
| Protease | 1.5 |
| Amylase | 0.5 |
| Anti-Foam | 0.5 |
| Perfume + Dye | 0.5 |

*2mixture of: 2% wt $C_{16}$-$C_{18}$ fatty alcohol 25 EO, 1% wt Dehypon ® 3697 GRA M (modified fatty alcohol polyglycolether ex Cognis) and 3% wt Plurafac ® LF305 (fatty alcohol alcoxylate ex BASF).

*3Norasol ™ LMW 45 (ex Fa. NorsoHaas).

*4Acusol ™ 445 NG (polyacrylic acid homopolymer ex Rohm & Haas). *5Luvitec ™ VA 64 (ex BASF).

TABLE 7a

| Glass Corrosion | | | | | | |
|---|---|---|---|---|---|---|
| | 50 cycles detergent from Table 6 | | | 50 Cycles detergent from Table 6 + 10 mg Lugalvan P ™ | | |
| Glasses | GC | LC | IR | GC | LC | IR |
| Longchamp | 3.5 | 3.5 | 0.5 | 2.0 | 1.5 | 1.0 |
| Julia Paola | 2.0 | 0.5 | 1.5 | 1.0 | 0.5 | 1.5 |
| Stoelzle 205 00 11 | 2.5 | 3.5 | 0.5 | 1.0 | 1.5 | 0.5 |
| Arcoroc RTM Elegance | 3.5 | 4.0 | 1.5 | 2.0 | 2.5 | 1.5 |
| Fiori | 3.5 | 4.0 | 2.0 | 1.5 | 2.0 | 1.5 |
| Average | 3.0 | 3.1 | 1.2 | 1.5 | 1.6 | 1.2 |
| Decorated Glassware | | DD | | | DD | |
| Sweet Animals | | 4.0 | | | 2.5 | |
| Latte Macchiato | | 3.5 | | | 2.0 | |
| Average | | 3.8 | | | 2.3 | |

TABLE 7b

| Mass Loss | | |
|---|---|---|
| | 50 cycles detergent from Table 6 Mass Loss (mg) | 50 Cycles detergent from Table 6 + 100 mg Lugalvan P ™ Mass Loss (mg) |
| Glasses | | |
| Longchamp | 115 | 15 |
| Julia Paola | 132 | 18 |
| Stoelzle 205 00 11 | 94 | 17 |
| ArcorocRTM Elegance | 50 | 10 |
| Fiori | 46 | 8 |
| Sum | 437 | 68 |
| Decorated Glassware | | |
| Sweet Animals | 420 | 110 |
| Latte Macchiato | 95 | 36 |
| Sum | 515 | 146 |

The use of 100 mg (0.5 wt %) Lugalvan P™ in addition to the detergent tablet, provides non-decorated glassware corrosion protection and decorated glassware protection. Glass clouding, line corrosion, décor damage and mass loss after 50 dishwashing cycles are reduced dramatically.

Example 5

In this example the ethyleneimine oligomer mixture used in Example 2 was added to the rinse aid composition shown in Table 8.

TABLE 8

| Component of Rinse Aid | % |
|---|---|
| Nonionic Surfactant*6 | 13.0 |
| Na-Cumene Sulphonate | 3.0 |
| Citric acid | 0.7 |
| Potassium Sorbate | 0.099 |
| Biocide | 0.001 |
| Water | 79.9 |
| Polyalkyleneimine oligomer mixture (average Mn~423) | 3.3 |

*6Plurafac RTM LF 221 (ex BASF)

Three ml of the rinse aid composition was added at the beginning of the automatic dishwasher rinse cycle. In the main wash cycle the detergent of Comparative Example 1 was used.

The protection performance on glasses and decoration is shown in Table 9a (Glass Corrosion) and Table 9b (Mass Loss).

TABLE 9a

| Glass Corrosion | | | | | | |
|---|---|---|---|---|---|---|
| | 25 cycles | | | 50 Cycles | | |
| Glasses | GC | LC | IR | GC | LC | IR |
| Longchamp | 2.0 | 1.5 | 1.0 | 2.5 | 1.5 | 1.0 |
| Julia Paola | 2.5 | 0.5 | 2.0 | 2.5 | 0.5 | 1.5 |
| Stoelzle 205 00 11 | 2.0 | 1.0 | 1.0 | 2.5 | 1.5 | 1.0 |
| Arcoroc RTM Elegance | 2.5 | 1.5 | 2.0 | 2.5 | 2.0 | 2.0 |
| Fiori | 2.0 | 2.0 | 1.0 | 2.5 | 1.5 | 1.5 |
| Average | 2.2 | 1.3 | 1.4 | 2.5 | 1.4 | 1.4 |
| Decorated Glassware | | DD | | | DD | |
| Sweet Animals | | 2.5 | | | 2.5 | |
| Latte Macchiato | | 3.0 | | | 3.0 | |
| Escapada | | 2.5 | | | 3.0 | |
| Average | | 2.7 | | | 2.8 | |

TABLE 9b

| Mass Loss | | |
|---|---|---|
| | 25 cycles Mass Loss (mg) | 50 cycles Mass Loss (mg) |
| Glasses | | |
| Longchamp | 5 | 10 |
| Julia Paola | 14 | 34 |
| Stoelzle 205 00 11 | 10 | 11 |
| Arcoroc RTM Elegance | 9 | 14 |
| Fiori | 8 | 12 |
| Sum | 46 | 80 |
| Decorated Glassware | | |
| Sweet Animals | 72 | 155 |
| Latte Macchiato | 13 | 34 |
| Escapada | 154 | 333 |
| Sum | 239 | 522 |

The rinse aid provides non-decorated glassware corrosion protection and decorated glassware protection. Glass clouding, line corrosion, décor damage and mass loss are reduced.

While several possible embodiments are disclosed above, embodiments of the present invention are not so limited. These exemplary embodiments are not intended to be exhaustive or to unnecessarily limit the scope of the invention, but instead were chosen and described in order to explain the principles of the present invention so that others skilled in the art may practice the invention. Indeed, various modifications of the invention in addition to those described herein will become apparent to those skilled in the art from the foregoing description. Such modifications are intended to fall within the scope of the appended claims.

What is claimed is:

1. A composition comprising a polyalkyleneimine, a salt of a polyalkyleneimine, and/or a derivative of a polyalkyleneimine in an amount of 0.01 mg to 10 mg per wash and/or rinse cycle of an automatic dishwashing machine, wherein the composition is provided to the automatic dishwashing machine.

2. The composition according to claim 1, wherein the number average molecular weight of the polyalkyleneimine, the salt of the polyalkyleneimine, and/or the derivative of the polyalkyleneimine is in the range of from 100 to 5,000,000.

3. The composition according to claim 1, wherein the polyalkyleneimine, the salt of the polyalkyleneimine, and/or the derivative of the polyalkyleneimine comprises a polyethyleneimine, a salt of a polyethyleneimine, and a derivative of a polyethyleneimine.

4. The composition according to claim 3, wherein the composition comprises a polyethyleneimine.

5. The composition according to claim 1, wherein the composition is an automatic dishwashing composition comprising the polyalkyleneimine, the salt of the polyalkyleneimine, and/or the derivative of the polyalkyleneimine in an amount of from 0.0001 wt % to 50 wt % of the composition.

6. The composition according to claim 1, wherein the composition is an automatic dishwashing rinse aid comprising the polyalkyleneimine, the salt of the polyalkyleneimine, and/or the derivative of the polyalkyleneimine in an amount of from 0.0005 wt % to 70 wt % of the composition.

7. The composition according to claim 1, wherein the composition is a water softening salt composition comprising the polyalkyleneimine, the salt of the polyalkyleneimine, and/or the derivative of the polyalkyleneimine in an amount of from 0.0001 wt % to 90 wt % of the composition.

8. The composition according to claim 1, wherein the composition is a machine cleaner or machine additive composition comprising the polyalkyleneimine, the salt of the polyalkyleneimine, and/or the derivative of the polyalkyleneimine in an amount of from 0.0001% wt-90% wt of the composition.

9. The composition according to claim 1, wherein the composition is in a form selected from the group consisting of a liquid, a gel, a powder, and a tablet.

10. The composition according to claim 9, wherein the composition is at least partially present in a water-soluble pouch.

11. The composition according to claim 9, wherein the composition is at least partially coated with a water-soluble coating.

12. The composition according to claim 9, wherein when the composition is in the form of a liquid or a gel, the polyalkyleneimine, the salt of the polyalkyleneimine, and/or the derivative of the polyalkyleneimine is soluble in the liquid or gel.

13. The composition according to claim 9, wherein when the composition is in the form of a liquid or a gel, the polyalkyleneimine, the salt of the polyalkyleneimine, and/or the derivative of the polyalkyleneimine is insoluble in the liquid or gel.

14. The composition according to claim 10, wherein the water-soluble pouch comprises the polyalkyleneimine, the salt of the polyalkyleneimine, and/or the derivative of the polyalkyleneimine.

15. The composition according to claim 11, wherein the water-soluble coating comprises the polyalkyleneimine, the salt of the polyalkyleneimine, and/or the derivative of the polyalkyleneimine.

16. An automatic dishwashing detergent composition comprising a polyalkyleneimine, a salt of a polyalkyleneimine, and/or a derivative of a polyalkyleneimine in an amount of 0.01 mg to 10 mg per wash and/or rinse cycle of an automatic dishwashing machine.

17. The automatic dishwashing detergent composition according to claim 16, wherein the polyalkyleneimine, the salt of the polyalkyleneimine, and/or the derivative of the polyalkyleneimine is present in an amount of from 0.0001% wt-50% wt of the automatic dishwashing detergent composition.

18. The automatic dishwashing detergent composition according to claim 16, wherein the automatic dishwashing detergent is in the form of a tablet.

19. The automatic dishwashing detergent composition according to claim 16, wherein the automatic dishwashing detergent is at least partially present in a water-soluble pouch.

20. The automatic dishwashing detergent composition according to claim 16, wherein the polyalkyleneimine, the salt of the polyalkyleneimine, and/or the derivative of the polyalkyleneimine has a number average molecular weight in the range of from 100 to 5,000,000.

* * * * *